US008672775B2

(12) United States Patent
Higuchi et al.

(10) Patent No.: US 8,672,775 B2
(45) **Date of Patent: *Mar. 18, 2014**

(54) MULTI-PIECE SOLID GOLF BALL

(75) Inventors: Hiroshi Higuchi, Chichibu (JP); Junji Umezawa, Chichibu (JP); Toru Ogawana, Chichibu (JP); Hiroyuki Nagasawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 450 days.

This patent is subject to a terminal disclaimer.

(21) Appl. No.: 12/979,747

(22) Filed: Dec. 28, 2010

(65) Prior Publication Data

US 2011/0098132 A1 Apr. 28, 2011

Related U.S. Application Data

(63) Continuation-in-part of application No. 12/402,543, filed on Mar. 12, 2009, now Pat. No. 7,909,710.

(51) Int. Cl.
*A63B 37/06* (2006.01)

(52) U.S. Cl.
USPC ..... 473/373

(58) Field of Classification Search
USPC ..... 473/373, 374, 376
See application file for complete search history.

(56) References Cited

U.S. PATENT DOCUMENTS 5,306,760 A 4/1994 Sullivan
5,312,857 A 5/1994 Sullivan
5,830,085 A 11/1998 Higuchi et al.
6,277,035 B1 8/2001 Sullivan et al.
6,277,924 B1 8/2001 Hamada et al.
6,409,614 B1 6/2002 Binette et al.
6,561,928 B2 5/2003 Binette et al.
6,565,455 B2 5/2003 Hayashi et al.
6,642,314 B2 11/2003 Sone et al.
6,663,507 B1 12/2003 Watanabe et al.

(Continued)

FOREIGN PATENT DOCUMENTS

JP 7268132 A 10/1995
JP 11035633 A 2/1999

(Continued)

OTHER PUBLICATIONS

U.S. Appl. No. 12/361,075, filed Jan. 28, 2009 (now abandoned), to Hiroshi Higuchi et al.

*Primary Examiner* — Raeann Gorden
(74) *Attorney, Agent, or Firm* — Sughrue Mion, PLLC

(57) ABSTRACT

The invention provides a multi-piece solid golf ball composed of a solid core, a cover, at least one intermediate layer situated therebetween, and a plurality of dimples on a surface of the ball. The diameter of the solid core, the deflection of the core when compressed under a final load of 130 kgf from an initial load of 10 kgf, the hardness at the center of the core, the hardness in a region 5 mm to 10 mm from the center of the core, the hardness 15 mm from the center of the core, and the surface hardness are set within specific ranges. The intermediate layer is composed primarily of a material obtained by mixing under applied heat a specific resin composition and the cover is formed primarily of polyurethane. And, the number of dimples and the trajectory volume TVT are set within specific ranges. The golf ball of the invention has an excellent flight performance, feel, controllability and scuff resistance.

8 Claims, 2 Drawing Sheets

(56) References Cited

U.S. PATENT DOCUMENTS

| | | | | |
|---|---|---|---|---|
| 6,723,008 | B2 | 4/2004 | Higuchi et al. | |
| 6,991,562 | B2 | 1/2006 | Sullivan et al. | |
| 7,160,211 | B2 | 1/2007 | Sullivan et al. | |
| 7,160,940 | B2 | 1/2007 | Hayashi et al. | |
| 7,294,680 | B2 | 11/2007 | Sone et al. | |
| 7,344,455 | B1 | 3/2008 | Higuchi | |
| 7,390,852 | B2 | 6/2008 | Hayashi et al. | |
| 7,510,488 | B2 | 3/2009 | Higuchi et al. | |
| 7,510,489 | B2 | 3/2009 | Higuchi | |
| 7,727,085 | B2 | 6/2010 | Higuchi et al. | |
| 7,909,710 | B2 * | 3/2011 | Higuchi et al. | 473/373 |
| 2003/0040378 | A1 | 2/2003 | Endo et al. | |
| 2004/0198534 | A1 | 10/2004 | Sasaki | |

FOREIGN PATENT DOCUMENTS

| | | | |
|---|---|---|---|
| JP | 2002085589 | A1 | 3/2002 |
| JP | 2002293996 | A | 10/2002 |
| JP | 2003052855 | A | 2/2003 |
| JP | 2004-49913 | A | 2/2004 |
| JP | 3505922 | B2 | 3/2004 |
| JP | 2004180797 | A | 7/2004 |
| JP | 2004305426 | A | 11/2004 |
| JP | 3772252 | B2 | 5/2006 |
| WO | 98/46671 | A1 | 10/1998 |

* cited by examiner

MULTI-PIECE SOLID GOLF BALL

CROSS-REFERENCE TO RELATED APPLICATION

This application is a continuation-in-part of copending application Ser. No. 12/402,543 filed on Mar. 12, 2009, the entire contents of which are hereby incorporated by reference.

BACKGROUND OF THE INVENTION

The present invention relates to a multi-piece solid golf ball of three or more layers which is composed of a solid core, an intermediate layer and a cover, and is endowed with excellent properties such as flight performance, feel on impact and controllability.

In recent years, the number of layers in solid golf balls has been increased from the conventional two-piece ball construction composed of a solid core and a cover by additionally providing an intermediate layer between the solid core and the cover, and efforts are being made to optimize each of the layers. Various three-piece golf balls have been disclosed in which a good flight performance and an excellent durability, feel and controllability are achieved by giving the core itself an optimized hardness profile and by providing the ball as a whole—including the core, the intermediate layer and the cover—with an optimized hardness profile.

For example, JP No. 3505922 (and the corresponding specification of U.S. Pat. No. 5,830,085) discloses a three-piece solid golf ball having a core, an intermediate layer and a cover, which ball satisfies the following relationship: core center hardness<core surface hardness<intermediate layer hardness<cover hardness. However, this golf ball has a low rebound.

JP No. 3772252 (and the corresponding specification of U.S. Pat. No. 6,565,455) discloses the use of the specific resin mixture mentioned in paragraph [0007] as the intermediate layer and/or cover material. Although using such an intermediate layer and/or cover material does enable a high rebound to be achieved in the golf ball, improving the durability remains a problem.

U.S. Pat. Nos. 6,409,614, 6,277,035 and 7,160,211 disclose multi-piece solid golf balls having a core, a soft inner cover and a hard outer cover, which outer cover is an ionomer cover having a high Shore D hardness. However, because the cover is too hard, these golf balls have a low spin performance on approach shots.

In the golf ball of U.S. Pat. No. 6,561,928, the total thickness of the cover encasing the core is too large, resulting in a decrease in flight performance. Other prior art includes the multi-piece solid golf ball disclosed in JP-A 2004-49913 (and the corresponding specification of U.S. Pat. No. 6,663,507).

U.S. Pat. No. 6,991,562 discloses a multi-piece solid golf ball having an inner cover layer formed of an ordinary ionomeric resin and an outer cover layer formed of a urethane resin. However, because this ball has a low rebound, achieving both a good flight performance and a good spin performance on approach shots is difficult.

Because the many multi-piece solid golf balls which have been disclosed to date fail to satisfy all the desired attributes—namely, flight performance, feel on impact, controllability/spin performance and durability, a need has been felt for further improvement.

SUMMARY OF THE INVENTION

It is therefore an object of the present invention to provide a multi-piece golf ball of at least three layers which has a solid core, an intermediate layer and a cover, and which is endowed with an excellent flight performance, feel, controllability and durability.

The inventors have conducted extensive investigations in order to achieve the above object. As a result, they have discovered that, in a multi-piece solid golf ball having a core, an intermediate layer and a cover, by optimizing the core hardness profile and by optimizing also the relationship between the intermediate layer, cover and core surface hardnesses, the ball can be imparted with an excellent feel on impact and an excellent spin performance on approach shots, in addition to which the ball can be conferred with a low spin rate on full shots, enabling an improved distance to be achieved. Moreover, the inventors have found that by using a highly neutralized ionomer in the intermediate layer and using a polyurethane in the cover material, it is possible to achieve in the same ball a lower spin rate on shots with a driver, an enhanced spin performance on approach shots and an improved scuff resistance.

Accordingly, the invention provides the following multi-piece solid golf balls.

[1] A multi-piece solid golf ball comprising a solid core, a cover, at least one intermediate layer situated therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to 10 mm from the core center of from 23 to 41, a Shore D hardness 15 mm from the core center of from 28 to 46, and a Shore D hardness at a surface of the core of from 37 to 62; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random copolymer so and/or a metal salt thereof, (b) from 0 to 20 wt % of an olefin-unsaturated carboxylic acid random copolymer and/or a metal salt thereof, and (c) from 5 to 50 wt % of a thermoplastic block copolymer composed of a crystalline polyolefin block and a polyethylene/butylene random copolymer, (d) from 5 to 170 parts by weight of a fatty acid or fatty acid derivative having a molecular weight of from 280 to 1500, and (e) from 0.1 to 10 parts by weight of a basic inorganic metal compound capable of neutralizing acid groups within components (a) and (d);

the intermediate layer material has a Shore D hardness of from 35 to 60 and has a Shore D hardness difference with the surface of the solid core of within ±10; the cover is formed primarily of polyurethane, has a thickness of from 0.5 to 1.5 mm, and has a Shore D hardness of from 53 to 65 which is higher than the intermediate layer hardness, the Shore D hardness difference therebetween being from 6 to 15; the overall ball has a deflection, when compressed under a final load of 130 kgf from an initial load of 10 kgf, of from 2.9 to 5.0 mm; and the number of dimples is from 250 to 400 and the sum of the dimple trajectory volumes VT (total dimple trajectory volume TVT) obtained by multiplying the volume of each dimple by the square root of the dimple diameter is from 640 to 800.

[2] A multi-piece solid golf ball comprising a solid core, a cover, at least one intermediate layer situated therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to 10 mm from the core center of from 23 to 41, a Shore D hardness 15 mm from the core center of from 28 to 46, and a Shore D hardness at a surface of the core of from 37 to 62; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random copolymer and/or a metal salt thereof, (b) from 0 to 20 wt % of an olefin-unsaturated carboxylic acid random copolymer and/or a metal salt thereof, and (c) from 5 to 50 wt % of a thermoplastic block copolymer composed of a crystalline polyolefin block and a polyethylene/butylene random copolymer, (d) from 5 to 170 parts by weight of a fatty acid or fatty acid derivative having a molecular weight of from 280 to 1500, and (e) from 0.1 to 10 parts by weight of a basic inorganic metal compound capable of neutralizing acid groups within components (a) and (d);

the intermediate layer has a thickness of from 1.0 to 2.5 mm; the intermediate layer material a Shore D hardness difference with the surface of the solid core of within ±10; the cover is formed primarily of polyurethane, has a thickness of from 0.5 to 1.5 mm, and has a Shore D hardness higher than the intermediate layer hardness, the Shore D hardness difference therebetween being from 6 to 15; the cover and the intermediate layer have a combined thickness of from 1.5 to 3.5 mm; and the overall ball has a deflection, when compressed under a final load of 130 kgf from an initial load of 10 kgf, of from 2.9 to 5.0 mm; and the number of dimples is from 250 to 400 and the sum of the dimple trajectory volumes VT (total dimple trajectory volume TVT) obtained by multiplying the volume of each dimple by the square root of the dimple diameter is from 640 to 800.

[3] A multi-piece solid golf ball comprising a solid core, a cover, at least one intermediate layer situated therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to 10 mm from the core center of from 23 to 41, a Shore D hardness 15 mm from the core center of from 28 to 46, and a Shore D hardness at a surface of the core of from 37 to 62; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random copolymer and/or a metal salt thereof, (b) from 0 to 20 wt % of an olefin-unsaturated carboxylic acid random copolymer and/or a metal salt thereof, and (c) from 5 to 50 wt of a thermoplastic block copolymer composed of a crystalline polyolefin block and a polyethylene/butylene random copolymer, (d) from 5 to 170 parts by weight of a fatty acid or fatty acid derivative having a molecular weight of from 280 to 1500, and (e) from 0.1 to 10 parts by weight of a basic inorganic metal compound capable of neutralizing acid groups within components (a) and (d);

the intermediate layer has a thickness of from 1.0 to 2.5 mm; the intermediate layer material has a Shore D hardness of from 35 to 60; the cover is formed primarily of polyurethane, has a thickness of from 0.5 to 1.5 mm, and has a Shore D hardness of from 53 to 65; the cover and the intermediate layer have a combined thickness of from 1.5 to 3.5 mm; and the overall ball has a deflection, when compressed under a final load of 130 kgf from an initial load of 10 kgf, of from 2.9 to 5.0 mm; and the number of dimples is from 250 to 400 and the sum of the dimple trajectory volumes VT (total dimple trajectory volume TVT) obtained by multiplying the volume of each dimple by the square root of the dimple diameter is from 640 to 800.

[4] A multi-piece solid golf ball comprising a solid core, a cover, at least one intermediate layer situated therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to 10 mm from the core center of from 23 to 41, a Shore D hardness 15 mm from the core center of from 28 to 46, a Shore D hardness at a surface of the core of from 37 to 62 and a Shore D hardness difference of 5 to 30 between the surface and the center; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random copolymer and/or a metal salt thereof, (b) from 0 to 20 wt % of an olefin-unsaturated carboxylic acid random copolymer and/or a metal salt thereof, and (c) from 5 to 50 wt % of a thermoplastic block copolymer composed of a crystalline polyolefin block and a polyethylene/butylene random copolymer, (d) from 5 to 170 parts by weight of a fatty acid or fatty acid derivative having a molecular weight of from 280 to 1500, and (e) from 0.1 to 10 parts by weight of a basic inorganic metal compound capable of neutralizing acid groups within components (a) and (d);

the intermediate layer has a thickness of from 1.0 to 2.5 mm; the intermediate layer material has a Shore D hardness difference with the surface of the solid core of within ±10; the cover is formed primarily of polyurethane, has a thickness of from 0.5 to 1.5 mm, and has a Shore D hardness higher than the intermediate layer hardness, the Shore D hardness difference therebetween being from 6 to 15; the cover and the intermediate layer have a combined thickness of from 1.5 to 3.5 mm; and the overall ball has a deflection, when compressed under a final load of 130 kgf from an initial load of 10 kgf, of from 2.9 to 5.0 mm; and the number of dimples is from 250 to 400 and the sum of the dimple trajectory volumes VT (total dimple trajectory volume TVT) obtained by multiplying the volume of each dimple by the square root of the dimple diameter is from 640 to 800.

BRIEF DESCRIPTION OF THE DIAGRAMS

DETAILED DESCRIPTION OF THE INVENTION

Figure 1:
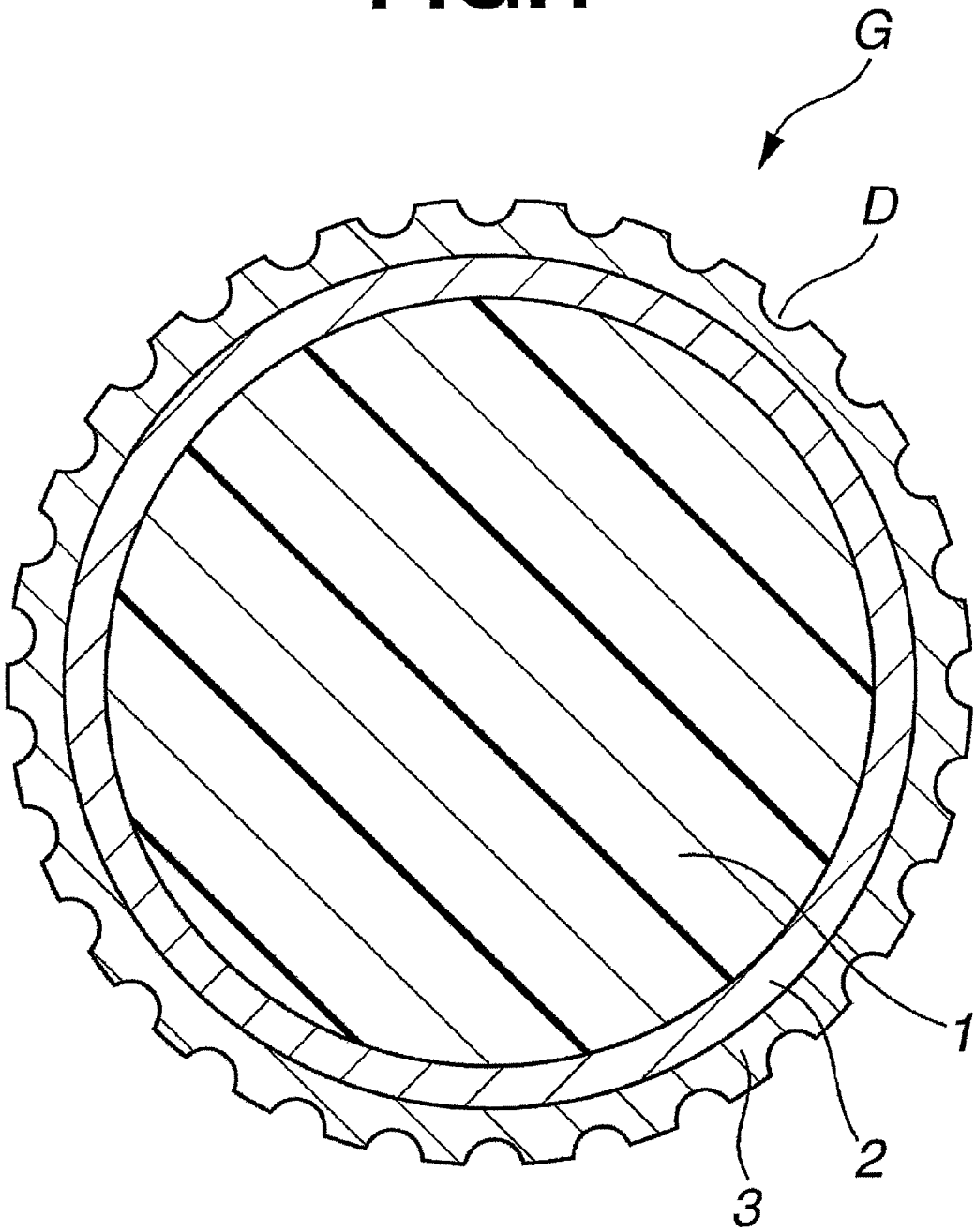
FIG. 1 is a cross-sectional view showing a multi-piece solid golf ball according to one embodiment of the invention.

Describing the invention more fully below in conjunction with the attached diagrams, the multi-piece golf ball of the invention has at least a three-layer construction composed of a solid core 1, an intermediate layer 2 encasing the solid core 1, and a cover 3 encasing the intermediate layer 2. A plurality of dimples D are formed on the surface of the cover 3. FIG. 1 shows a construction in which the solid core 1, the intermediate layer 2, and the cover 3 are each composed of one layer, although any of these parts may be composed of two or more layers. If necessary, the solid core 1, the intermediate layer 2 and the cover 3 may each have a multilayer construction. When the solid core, intermediate layer or cover described below has a multilayer construction, the multiple layers together should be configured in such a way as to collectively satisfy the conditions which pertain to that part of the golf ball.

First, the solid core is described. The solid core is molded under the application of heat from a rubber composition containing polybutadiene as the base rubber.

Here, the polybutadiene has a cis-1,4 bond content of at least 60%, preferably at least 80%, more preferably at least 90%, and most preferably at least 95%.

It is recommended that the polybutadiene have a Mooney viscosity ($ML_{1+4}$ (100° C.)) of at least 30, preferably at least 35, more preferably at least 40, even more preferably at least 50, and most preferably at least 52, but not more than 100, preferably not more than 80, more preferably not more than 70, and most preferably not more than 60.

The term "Mooney viscosity" used herein refers to an industrial indicator of viscosity as measured with a Mooney viscometer, which is a type of rotary plastometer (JIS-K6300). The unit symbol used is $ML_{1+4}$ (100° C.), where "M" stands for Mooney viscosity, "L" stands for large rotor (L-type), "1+4" denotes a pre-heating time of 1 minute and a rotor rotation time of 4 minutes, and "100° C." indicates that measurement was carried out at a temperature of 100° C.

The molecular weight distribution Mw/Mn (where Mw stands for the weight-average molecular weight, and Mn stands for the number-average molecular weight) of the above polybutadiene is at least 2.0, preferably at least 2.2, more preferably at least 2.4, and even more preferably at least 2.6, but not more than 6.0, preferably not more than 5.0, more preferably not more than 4.0, and even more preferably not more than 3.4. If Mw/Mn is too small, the workability may worsen. On the other hand, if it is too large, the rebound may decrease.

The polybutadiene may be synthesized using a nickel or cobalt catalyst, or may be synthesized using a rare-earth catalyst. Synthesis with a rare-earth catalyst is especially preferred. A known rare-earth catalyst may be used for this purpose.

Examples include catalysts obtained by combining a lanthanum series rare-earth compound, an organoaluminum compound, an alumoxane, a halogen-bearing compound and, if necessary, a Lewis base.

In the present invention, the use of a neodymium catalyst containing a neodymium compound as the lanthanum series rare-earth compound is advantageous because it enables a polybutadiene rubber having a high 1,4-cis bond content and a low 1,2-vinyl bond content to be obtained at an excellent polymerization activity. Preferred examples of such rare-earth catalysts include those mentioned in JP-A 11-35633.

When butadiene is polymerized in the presence of a rare-earth catalyst, bulk polymerization or vapor-phase polymerization may be carried out, with or without the use of a solvent. The polymerization temperature may be set to generally between −30° C. and 150° C., and preferably between 10 and 100° C.

Alternatively, the polybutadiene may be obtained by polymerization using the rare-earth catalyst, followed by the reaction of an active end on the polymer with a terminal modifier.

Examples of terminal modifiers and methods for carrying out such a reaction include those described in, for example, JP-A 11-35633, JP-A 7-268132 and JP-A 2002-293996.

The polybutadiene is included in the rubber base in an amount of at least 60 wt %, preferably at least 70 wt %, more preferably at least 80 wt %, and most preferably at least 90 wt %. The upper limit in the amount of polybutadiene included is 100 wt % or less, preferably 98 wt % or less, and more preferably 95 wt % or less. When too little polybutadiene is included in the rubber base, it is difficult to obtain a golf ball having a good rebound.

Rubbers other than the above-described polybutadiene may be included and used together with the polybutadiene insofar as the objects of the invention are attainable. Illustrative examples include polybutadiene rubbers (BR), is styrene-butadiene rubbers (SBR), natural rubbers, polyisoprene rubbers, and ethylene-propylene-diene rubbers (EPDM). These may be used singly or as combinations of two or more thereof.

The hot-molded solid core is formed using a rubber composition prepared by blending, as essential ingredients, specific amounts of an unsaturated carboxylic acid or a metal salt thereof, an organosulfur compound, an inorganic filler and an antioxidant with 100 parts by weight of the above-described base rubber.

The unsaturated carboxylic acid is exemplified by acrylic acid, methacrylic acid, maleic acid and fumaric acid. Acrylic acid and methacrylic acid are especially preferred.

Metal salts of unsaturated carboxylic acids that may be used include the zinc and magnesium salts of unsaturated fatty acids, such as zinc methacrylate and zinc acrylate. The use of zinc acrylate is especially preferred.

The amount of unsaturated carboxylic acid and/or metal salt thereof included per 100 parts by weight of the base rubber is preferably at least 20 parts by weight, more preferably at least 22 parts by weight, even more preferably at least 24 parts by weight, and most preferably at least 26 parts by weight, but preferably not more than 45 parts by weight, more preferably not more than 40 parts by weight, even more preferably not more than 35 parts by weight, and most preferably not more than 30 parts by weight. Including too much will result in excessive hardness, giving the ball an unpleasant feel when played. On the other hand, including too little will result in a decrease in the rebound.

An organosulfur compound may optionally be included. The organosulfur compound can be advantageously used to impart an excellent rebound. Thiophenols, thionaphthols, halogenated thiophenols, and metal salts thereof are recommended for this purpose. Illustrative examples include pentachlorothiophenol, pentafluorothiophenol, pentabromothiophenol, p-chlorothiophenol, and the zinc salt of pentachlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

The amount of the organosulfur compound included per 100 parts by weight of the base rubber is preferably at least 0 part by weight, more preferably at least 0.1 part by weight, even more preferably at least 0.2 part by weight, and most preferably at least 0.4 part by weight, but preferably not more than 5 parts by weight, more preferably not more than 4 parts by weight, even more preferably not more than 3 parts by weight, and most preferably not more than 2 parts by weight. Including too much organosulfur compound may excessively lower the hardness, whereas including too little is unlikely to improve the rebound.

The inorganic filler is exemplified by zinc oxide, barium sulfate and calcium carbonate. The amount of the inorganic filler included per 100 parts by weight of the base rubber is preferably at least 5 parts by weight, more preferably at least 6 parts by weight, even more preferably at least 7 parts by weight, and most preferably at least 8 parts by weight, but preferably not more than 80 parts by weight, more preferably not more than 60 parts by weight, even more preferably not more than 40 parts by weight, and most preferably not more than 20 parts by weight. Too much or too little inorganic filler may make it impossible to achieve a suitable weight and a good rebound.

The organic peroxide may be a commercial product, examples of which include those available under the trade names Percumyl D (produced by NOF Corporation), Perhexa 3M (NOF Corporation), Perhexa C(NOF Corporation), and Luperco 231XL (Atochem Co.). The use of Perhexa 3M or Perhexa C is preferred.

A single organic peroxide may be used alone or two or more different organic peroxides may be mixed and used together. Mixing two or more different organic peroxides is preferred from the standpoint of further enhancing rebound.

The amount of the organic peroxide included per 100 parts of the base rubber is preferably at least 0.1 part by weight, more preferably at least 0.2 part by weight, and even more preferably at least 0.3 part by weight, but preferably not more than 2 parts by weight, more preferably not more than 1.5 parts by weight, and even more preferably not more than 1 part by weight. Including too much or too little organic peroxide may prevent the desired hardness profile from being achieved, making it impossible, in turn, to achieve the desired feel, durability and rebound.

In the present invention, an antioxidant may be included if necessary. Illustrative examples of the antioxidant include commercial products such as Nocrac NS-6 and Nocrac NS-30 (both produced by Ouchi Shinko Chemical Industry Co., Ltd.), and Yoshinox 425 (Yoshitomi Pharmaceutical Industries, Ltd.).

To achieve a good rebound and durability, it is recommended that the amount of the antioxidant included per 100 parts by weight of the base rubber be preferably at least 0 part by weight, more preferably at least 0.03 part by weight, and even more preferably at least 0.05 part by weight, but preferably not more than 0.4 part by weight, more preferably not more than 0.3 part by weight, and even more preferably not more than 0.2 part by weight.

Sulfur may also be added if necessary. Such sulfur is exemplified by the product manufactured by Tsurumi Chemical Industry Co., Ltd. under the trade name "Sulfur Z." The amount of sulfur included per 100 parts by weight of the base rubber is preferably at least 0 part by weight, more preferably at least 0.005 part by weight, and more preferably at least 0.01 part by weight, but preferably not more than 0.5 part by weight, more preferably not more than 0.4 part by weight, and even more preferably not more than 0.1 part by weight. By adding sulfur, the core hardness profile can be increased. Adding too much sulfur may result in undesirable effects during hot molding, such as explosion of the rubber composition, or may considerably lower the rebound.

To achieve the subsequently described specific core hardness profile and core deflection, the foregoing rubber composition is suitably selected and fabrication of the solid core (hot-molded piece) is carried out by vulcanization and curing according to a method similar to that used for conventional golf ball rubber compositions. Suitable vulcanization conditions include, for example, a vulcanization temperature of between 100° C. and 200° C., and a vulcanization time of between 10 and 40 minutes. To obtain the desired rubber crosslinked body for use as the core in the present invention, the vulcanizing temperature is preferably at least 150° C., and especially at least 155° C., but preferably not above 200° C., more preferably not above 190° C., even more preferably not above 180° C., and most preferably not above 170° C.

It is critical for the solid core of the invention to have a diameter between 34.0 and 38.7 mm. It is recommended that the solid core have a diameter of preferably at least 34.5 mm, more preferably at least 35.0 mm, even more preferably at least 35.5 mm, and most preferably at least 36.0 mm, but preferably not more than 38.2 mm, more preferably not more than 37.7 mm, even more preferably not more than 37.0 mm, and most preferably not more than 36.5 mm. At too small a diameter, the soft core becomes smaller, which may lower the ball rebound and result in a harder feel. On the other hand, at too large a diameter, the intermediate layer and cover necessarily become thinner, which may result in a poor durability.

The solid core has a center hardness, expressed as the Shore D hardness, of at least 20, preferably at least 25, more preferably at least 30, and even more preferably at least 33, but not more than 38, preferably not more than 37, even more preferably not more than 36, and most preferably not more than 35.

The solid core has a hardness in the region 5 mm to 10 mm from the center thereof, expressed as the Shore D hardness, of at least 23, preferably at least 28, more preferably at least 32, and even more preferably at least 35, but not more than 41, preferably not more than 40, even more preferably not more than 39, and most preferably not more than 38.

The region of the solid core 15 mm from the center has a hardness, expressed as the Shore D hardness, of at least 28, preferably at least 33, more preferably at least 36, and even more preferably at least 39, but not more than 46, preferably not more than 45, and even more preferably not more than 44.

The surface of the solid core has a hardness, expressed as the Shore D hardness, of at least 37, preferably at least 39, more preferably at least 41, and even more preferably at least 42, but not more than 62, preferably not more than 57, even more preferably not more than 52, and most preferably not more than 48.

The hardness difference between the surface and center of the solid core as expressed in Shore D hardness units, while not subject to any particular limitation, is preferably at least 5, and more preferably at least 6, but preferably not more than 30, more preferably not more than 25, and even more preferably not more than 20. At a hardness difference smaller than the above range, the spin rate on shots with a driver may rise, lowering the distance traveled by the ball. On the other hand, at a hardness difference larger than the above range, the rebound and durability of the ball may decrease.

The solid core has a deflection, when compressed under a final load of 130 kgf from an initial load of 10 kgf, of at least 3.5 mm, preferably at least 3.8 mm, and more preferably at least 4.1 mm, but not more than 6.0 mm, preferably not more than 5.5 mm, more preferably not more than 5.0 mm, and most preferably not more than 4.8 mm. Too small a deflection by the solid core may worsen the feel of the ball on impact and, particularly on long shots such as with a driver in which the ball incurs a large deformation, may subject the ball to an excessive rise in the spin rate, shortening the distance traveled by the ball. On the other hand, a solid core which is too soft may deaden the feel of the ball when played and result in a less than adequate rebound, shortening the distance traveled by the ball, and moreover may give the ball a poor durability to cracking on repeated impact.

Next, in the present invention, it is preferable to use as the intermediate layer material a resin mixture containing:

(a) from 95 to 50 wt % of an olefin-unsaturated carboxylic acid-unsaturated carboxylic acid ester random copolymer and/or a metal salt thereof, (b) from 0 to 20 wt % of an olefin-unsaturated carboxylic acid random copolymer and/or a metal salt thereof, and (c) from 5 to 50 wt % of a thermoplastic block copolymer composed of a crystalline polyolefin block and a polyethylene/butylene random copolymer.

The olefin-unsaturated carboxylic acid-unsaturated carboxylic acid ester random copolymer and/or a metal salt thereof serving as component (a) has a weight-average molecular weight (Mw) of preferably at least 100,000, more preferably at least 110,000, and even more preferably at least 120,000, but preferably not more than 200,000, more preferably not more than 190,000, and even more preferably not more than 170,000. The weight-average molecular weight (Mw) to number-average molecular weight (Mn) ratio for the copolymer is preferably at least 3, and more preferably at least 4, but preferably not more than 7, and more preferably not more than 6.5.

Above component (a) is an olefin-containing copolymer. The olefin in component (a) is exemplified by olefins in which the number of carbons is at least 2 but not more than 8, and preferably not more than 6. Illustrative examples of such olefins include ethylene, propylene, butene, pentene, hexene, heptene and octene. The use of ethylene is especially preferred.

Illustrative examples of the unsaturated carboxylic acid in component (a) include acrylic acid, methacrylic acid, maleic acid and fumaric acid. Acrylic acid and methacrylic acid are especially preferred.

The unsaturated carboxylic acid ester in component (a) may be, for example, a lower alkyl ester of an unsaturated carboxylic acid. Illustrative examples include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, isobutyl acrylate) is especially preferred.

The random copolymer serving as component (a) in the invention may be obtained by the random copolymerization of the above ingredients in accordance with a known method. It is recommended that the unsaturated carboxylic acid content (acid content) within the random copolymer be generally at least 2 wt %, preferably at least 6 wt %, and more preferably at least 8 wt %, but not more than 25 wt %, preferably not more than 20 wt %, and more preferably not more than 15 wt %. At a low acid content, the rebound may decrease, whereas at a high acid content, the material processability may decrease.

The copolymer of component (a) accounts for a proportion of the overall resin component which is from 95 to 50 wt %, preferably at least 60 wt %, more preferably at least 70 wt %, and even more preferably at least 75 wt %, but preferably not more than 92 wt %, more preferably not more than 89 wt %, and most preferably not more than 86 wt %.

The metal salt of the copolymer of component (a) may be obtained by neutralizing some of the acid groups in the random copolymer of component (a) with metal ions.

Examples of the metal ions which neutralize the acid groups include $Na^+$, $W^+$, $Li^+$, $Zn^{++}$, $Cu^{++}$, $Mg^{++}$, $Ca^{++}$, $Co^{++}$, $Ni^{++}$ and $Pb^{++}$. Of these, $Na^+$, $Li^+$, $Zn^{++}$, $Mg^{++}$ or $Ca^{++}$ are preferred, and $Zn^{++}$ is especially preferred. The degree of neutralization of the random copolymer by these metal ions, while not subject to any particular limitation, is generally at least 5 mol %, preferably at least 10 mol %, and especially at least 20 mol %, but not more than 95 mol %, preferably not more than 90 mol %, and especially not more than 80 mol %. At a degree of neutralization in excess of 95 mol %, the moldability may decrease. On the other hand, at less than 5 mol %, there arises a need to increase the amount in which the inorganic metal compound serving as component (c) is added, which may present a drawback in terms of cost. Such a neutralization product may be obtained by a known method. For example, the neutralization product may be obtained by introducing a metal ion compound, such as a formate, acetate, nitrate, carbonate, bicarbonate, oxide, hydroxide or alkoxide, into the random copolymer.

Illustrative examples of the olefin-unsaturated carboxylic acid-unsaturated carboxylic acid ester random copolymer serving as component (a) include those available under the trade names Nucrel AN4318, Nucrel AN4319, and Nucrel AN4311 (DuPont-Mitsui Polychemicals Co., Ltd.). Illustrative examples of the metal salts of olefin-unsaturated carboxylic acid-unsaturated carboxylic acid ester random copolymer include those available under the trade names Himilan AM7316, Himilan AM7331, Himilan 1855 and Himilan 1856 (DuPont-Mitsui Polychemicals Co., Ltd.), and those available under the trade names Surlyn 6320 and Surlyn 8120 (E.I. DuPont de Nemours and Co., Ltd.).

In cases where component (b) is blended with the resin of the above component (a), the olefin-unsaturated carboxylic acid random copolymer and/or metal salt thereof serving as component (b) has a weight-average molecular weight (Mw) of preferably at least 100,000, more preferably at least 110,000, and even more preferably at least 120,000, but preferably not more than 200,000, more preferably not more than 190,000, and even more preferably not more than 170,000. The weight-average molecular weight (Mw) to number-average molecular weight (Mn) ratio for the copolymer is preferably at least 3, and more preferably at least 4, but preferably not more than 7, and more preferably not more than 6.5.

Above component (b) is an olefin-containing copolymer. The olefin in component (b) is exemplified by olefins in which the number of carbons is at least 2 but not more than 8, and preferably not more than 6. Illustrative examples of such olefins include ethylene, propylene, butene, pentene, hexene, heptene and octene. The use of ethylene is especially preferred.

Illustrative examples of the unsaturated carboxylic acid in component (b) include acrylic acid, methacrylic acid, maleic acid and fumaric acid. Acrylic acid and methacrylic acid are especially preferred.

The random copolymer serving as component (b) in the invention may be obtained by the random copolymerization of the above ingredients in accordance with a known method. It is recommended here that the unsaturated carboxylic acid content (acid content) within the random copolymer be generally at least 2 wt %, preferably at least 6 wt %, and more preferably at least 8 wt %, but not more than 25 wt %, preferably not more than 20 wt %, and more preferably not more than 15 wt %. At a low acid content, the rebound may decrease, whereas at a high acid content, the material processability may decrease.

In the above case, the copolymer of component (b) accounts for a proportion of the overall base resin which is 0 wt % or more, and preferably at least 1 wt %, but not more than 20 wt %, preferably not more than 17 wt %, more preferably not more than 10 wt %, even more preferably not more than 8 wt %, and most preferably not more than 5 wt %.

The metal salt of the copolymer of component (b) may be obtained by neutralizing some of the acid groups in the random copolymer of component (b) with metal ions.

Examples of the metal ions which neutralize the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, $Na^+$, $Zn^{++}$, $Mg^{++}$ or $Ca^{++}$ are preferred, and $Zn^{++}$ is especially preferred. The degree of neutralization of the random copolymer by these metal ions, while not subject to any particular limitation, is generally at least 5 mol %, preferably at least 10 mol %, and especially at least 20 mol %, but not more than 95 mol %, preferably not more than 90 mol %, and especially not more than 80 mol %. At a degree of neutralization in excess of 95 mol %, the moldability may decrease. On the other hand, at less than 5 mol %, there arises a need to increase the amount in which the inorganic metal compound serving as component (c) is added, which may present a drawback in terms of cost. Such a neutralization product may be obtained by a known method. For example, the neutralization product may be obtained by introducing a metal ion compound, such as a formate, acetate, nitrate, carbonate, bicarbonate, oxide, hydroxide or alkoxide, into the random copolymer.

Illustrative examples of the olefin-unsaturated carboxylic acid random copolymer serving as component (b) include those available under the trade names Nucrel 1560, Nucrel 1525 and Nucrel 1035 (DuPont-Mitsui Polychemicals Co., Ltd.). Illustrative examples of the metal salts of the olefin-unsaturated carboxylic acid random copolymer include those available under the trade names Himilan 1605, Himilan 1601, Himilan 1557, Himilan 1705 and Himilan 1706 (DuPont-Mitsui Polychemicals Co., Ltd.), those available under the trade names Surlyn 7930 and Surlyn 7920 (E.I. DuPont de Nemours and Co., Ltd.), and those available under the trade names Escor 5100 and Escor 5200 (ExxonMobil Chemical).

When component (c) is used, the thermoplastic block copolymer composed of a crystalline polyolefin block and a polyethylene/butylene random copolymer which serves as component (c) is exemplified by thermoplastic block copolymers composed of a crystalline polyethylene block (E) as a hard segment and a block of a relatively random copolymer of ethylene and butylene (EB) as a soft segment. Preferred use may be made of block copolymers having a molecular structure with a hard segment at one or both ends, such as block copolymers having an E-EB or E-EB-E structure.

Such thermoplastic block copolymers composed of a crystalline polyolefin block and a polyethylene/butylene random copolymer which serve as component (c) may be obtained by hydrogenating polybutadiene.

A polybutadiene in which bonding within the butadiene structure is characterized by the presence of a block-like 1,4-polymer region having a 1,4-bond content of from 95 to 100 wt %, and in which the butadiene structure as a whole has a 1,4-bond content of from 50 to 100 wt %, and preferably from 80 to 100 wt %, may be advantageously used here as the polybutadiene subjected to hydrogenation. That is, preferred use may be made of a polybutadiene having a 1,4-bond content of 50 to 100 wt %, and preferably 80 to 100 wt %, and having a block-like 1,4-polymer region with a 1,4-bond content of 95 to 100 wt %.

The above-mentioned E-EB-E type thermoplastic block copolymer is preferably one obtained by hydrogenating a polybutadiene having at both ends of the molecular chain 1,4-polymerization products which are rich in 1,4-bonds and having an intermediate region where 1,4-bonds and 1,2-bonds are intermingled. The degree of hydrogenation (conversion of double bonds on the polybutadiene to saturated bonds) in the polybutadiene hydrogenate is preferably from 60 to 100%, and more preferably from 90 to 100%. Too low a degree of hydrogenation may give rise to undesirable effects such as gelation in the blending step with other components such as an ionomer resin and, when the golf ball is formed, may lead to problems associated with the intermediate layer, such as a poor durability to impact.

In the block copolymer having a E-EB or E-EB-E molecular structure with a hard segment at one or both ends that may be preferably used as the thermoplastic block copolymer, the content of the hard segments is preferably from 10 to 50 wt %. If the content of hard segments is too high, the intermediate layer may lack sufficient softness, making it difficult to effectively achieve the objects of the invention. On the other hand, if the content of hard segments is too low, the blend may have a poor moldability.

The thermoplastic block copolymer has a melt index, at 230° C. and under a test load of 21.2 N, of preferably from 0.01 to 15 g/10 min, and more preferably from 0.03 to 10 g/10 min. Outside of this range, problems such as weld lines, sink marks and short shots may arise during injection molding. Moreover, the thermoplastic block copolymer preferably has a surface hardness of from 10 to 50. If the surface hardness is too low, the golf ball may have a decreased durability to repeated impact. On the other hand, if the surface hardness is too high, blends of the thermoplastic block copolymer with an ionomer resin may have a decreased rebound. The thermoplastic block copolymer has a number-average molecular weight of preferably between 30,000 and 800,000.

Commercial products may be used as the above-described thermoplastic block copolymer composed of a crystalline polyolefin block and a polyethylene/butylene random copolymer. Illustrative examples include Dynaron 6100P, Dynaron 6200P and Dynaron 6201B available from JSR Corporation. Dynaron 6100P, which is a block polymer having crystalline olefin blocks at both ends, is especially preferred for use in the present invention. These olefinic thermoplastic elastomers may be used singly or as mixtures of two or more thereof.

In cases where component (c) is included in the base resin, the proportion of the overall base resin accounted for by the copolymer serving as component (c) is preferably at least 5 wt %, more preferably at least 8 wt %, even more preferably at least 11 wt %, and most preferably at least 14 wt %, but not more than 50 wt %, preferably not more than 40 wt %, even more preferably not more than 30 wt %, and most preferably not more than 20 wt %.

The intermediate layer material also includes, mixed therein per 100 parts by weight of above resin components (a) to (c):

(d) from 5 to 170 parts by weight of a fatty acid or fatty acid derivative having a molecular weight of from 280 to 1500; and (e) from 0.1 to 10 parts by weight of a basic inorganic metal compound capable of neutralizing acid groups within component (a), component (d) and, if necessary, component (b).

Component (d) is a fatty acid or fatty acid derivative having a molecular weight of at least 280 but not more than 1500 whose purpose is to enhance the flow properties of the heated mixture. It has a molecular weight which is much smaller than those of components (a) to (c), and helps to significantly decrease the melt viscosity of the mixture. Also, because the fatty acid (or fatty acid derivative) of component (d) has a molecular weight of at least 280 but not more than 1500 and has a high content of acid groups (or derivative moieties thereof), its addition to the resin material results in little if any loss of rebound.

The fatty acid or fatty acid derivative serving as component (d) may be an unsaturated fatty acid or fatty acid derivative having a double bond or triple bond in the alkyl moiety, or it may be a saturated fatty acid or fatty acid derivative in which all the bonds in the alkyl moiety are single bonds. It is recommended that the number of carbon atoms on the molecule be preferably at least 18, but preferably not more than 80, and more preferably not more than 40. Too few carbons may result in a poor heat resistance, and may also set the acid group content so high as to cause the acid groups to interact with acid groups present on the base resin, diminishing the flow-improving effects. On the other hand, too many carbons increases the molecular weight, which may significantly lower the flow properties and make the material difficult to use.

Specific examples of fatty acids that may be used as component (d) include stearic acid, 12-hydroxystearic acid, behenic acid, oleic acid, linoleic acid, linolenic acid, arachidic acid and lignoceric acid. Of these, preferred use may be made of stearic acid, arachidic acid, behenic acid, lignoceric acid and oleic acid.

The fatty acid derivative of component (d) is exemplified by derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (d) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

In the present invention, the amount of component (d) used per 100 parts by weight of the base resin is at least 0.5 parts by weight, preferably at least 20 parts by weight, more preferably at least 50 parts by weight, and even more preferably at least 85 parts by weight, but not more than 170 parts by weight, preferably not more than 150 parts by weight, even more preferably not more than 130 parts by weight, and most preferably not more than 110 parts by weight.

Use may also be made of known metallic soap-modified ionomers (see, for example, U.S. Pat. No. 5,312,857, U.S. Pat. No. 5,306,760 and International Disclosure WO 98/46671) when using above components (a) and (b).

Component (e) is a basic inorganic metal compound capable of neutralizing the acid groups in above component (a), component (d) and, if necessary, component (b). When, as illustrated in the prior-art examples, components (a), (b) and (d) alone, and in particular a metal-modified ionomer resin alone (e.g., a metal soap-modified ionomer resin of the type mentioned in the foregoing patent publications, alone), are heated and mixed, as mentioned below, the metallic soap and un-neutralized acid groups present on the ionomer undergo exchange reactions, generating a fatty acid. Because the fatty acid has a low thermal stability and readily vaporizes during molding, it causes molding defects. Moreover, if the fatty acid thus generated deposits on the surface of the molded material, it substantially lowers paint film adhesion. Component (e) is included so as to resolve such problems.

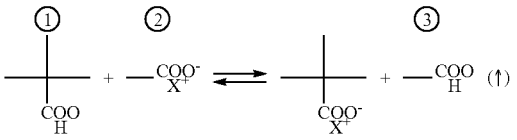

(1) un-neutralized acid group present on the ionomer resin
(2) metallic soap
(3) fatty acid
X: metal atom The heated mixture used in the present invention thus includes, as component (e), a basic inorganic metal compound which neutralizes the acid groups present in above components (a), (b) and (d). The inclusion of component (e) as an essential ingredient confers excellent properties. That is, the acid groups in above components (a), (b) and (d) are neutralized, and synergistic effects from the inclusion of each of these components increase the thermal stability of the heated mixture while at the same time conferring a good moldability, and also enhance the rebound of the golf ball.

It is recommended that above component (e) be a basic inorganic metal compound—preferably a monoxide or hydroxide—which is capable of neutralizing acid groups in above components (a), (b) and (d). Because such compounds have a high reactivity with the ionomer resin and the reaction by-products contain no organic matter, the degree of neutralization of the heated mixture can be increased without a loss of thermal stability.

The metal ions used here in the basic inorganic metal compound are exemplified by $Li^{+}$, $Na^{+}$, $K^{+}$, $Ca^{++}$, $Mg^{++}$, $Zn^{++}$, $Ni^{+}$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a monoxide or hydroxide is preferred. The use of magnesium oxide or calcium hydroxide, which have high reactivities with ionomer resins, is especially preferred.

Component (e) of the present invention is included in an amount, per 100 parts by weight of the base resin, of from 0.1 to 10 parts by weight, preferably at least 0.5 part by weight; more preferably at least 0.8 part by weight, and even more preferably at least 1 part by weight, but preferably not more than 8 parts by weight, more preferably not more than 5 parts by weight, and even more preferably not more than 4 parts by weight.

The heated mixture used in the present invention, which is obtained by blending components (a) to (e), can be provided with improved thermal stability, moldability and resilience. To this end, it is recommended that, in all heated mixtures used in the invention, at least 70 mol %, preferably at least 80 mol %, and more preferably at least 90 mol %, of the acid groups in the mixture be neutralized. A high degree of neutralization more reliably suppresses the exchange reactions that pose a problem in the above-described cases where components (a) and (b) and the fatty acid (or fatty acid derivative) alone are used, thus making it possible to prevent the generation of fatty acids. As a result, a material can be obtained which has a markedly increased thermal stability, a good moldability, and a substantially higher resilience than conventional ionomer resins.

Here, with regard to neutralization of the heated mixture of the invention, to more reliably achieve both a high degree of neutralization and good flow properties, it is recommended that the acid groups in the heated mixture be neutralized with transition metal ions and with alkali metal and/or alkaline earth metal ions. Because transition metal ions have a weaker ionic cohesion than alkali metal and alkaline earth metal ions, it is possible in this way to neutralize some of the acid groups in the heated mixture and thus enable the flow properties to be significantly improved.

In the present invention, various additives may also be optionally included in the above heated mixture. Additives which may be used include pigments, dispersants, antioxidants, ultraviolet absorbers and optical stabilizers. Moreover, to improve the feel of the golf ball on impact, the resin composition may also include, in addition to the above essential ingredients, various non-ionomeric thermoplastic elastomers. Illustrative examples of such non-ionomeric thermoplastic elastomers include styrene-based thermoplastic elastomers, ester-based thermoplastic elastomers and urethane-based thermoplastic elastomers. The use of styrene-based thermoplastic elastomers is especially preferred.

The method of preparing the heated mixture is exemplified by mixture under heating at a temperature of between 150 and 250° C. in an internal mixer such as a twin-screw extruder, a Banbury mixer or a kneader. The method of forming the intermediate layer using the heated mixture is not subject to any particular limitation. For example, the intermediate layer may be formed by injection molding or compression molding the heated mixture. When injection molding is employed, the process may involve placing a prefabricated solid core at a given position in the injection mold, then introducing the above-described material into the mold. When compression molding is employed, the process may involve producing a pair of half cups from the above-described material, covering the core with these half-cups, either directly or with an intervening intermediate layer, then applying pressure and heat within a mold. If molding under heat and pressure is carried out, the molding conditions may be a temperature of from 120 to 170° C. and a period of from 1 to 5 minutes.

In the invention, the intermediate layer material has a Shore D hardness, while not subject to any particular limitation, preferably in a range of 35 to 60, more preferably at least 40, even more preferably at least 43, and further more preferably at least 46, but preferably not more than 56, more preferably not more than 53, even more preferably not more than 51, and most preferably not more than 50. If the Shore D hardness is low, the rebound may decrease, resulting in a shorter distance.

The intermediate layer is formed to a thickness of, while not subject to any particular limitation, preferably at least 1.0 mm, more preferably at least 1.5 mm, even more preferably at least 1.7, further more preferably at least 1.8 mm, and most preferably at least 1.9 mm, but preferably not more than 2.5 mm, more preferably not more than 2.3 mm, further more preferably not more than 2.2 mm, and most preferably not more than 2.1 mm. If the intermediate layer is too thick, it will not be possible to enhance the feel and the distance and flight performance of the ball. On the other hand, if the intermediate layer is too thin, the distance and flight performance and the durability will worsen.

It is essential that the intermediate layer material have a melt flow rate (measured in accordance with JIS-K6760 (test temperature, 190° C.; test load, 21 N (2.16 kgf)) of from 5 to 30 g/10 min, preferably at least 7 g/10 min, more preferably at least 10 g/10 min, even more preferably at least 11 g/10 min, and most preferably at least 12 g/10 min, but preferably not more than 30 g/10 min, more preferably not more than 25 g/10 min, even more preferably not more than 21 g/10 min, and most preferably not more than 18 g/10 min. If the melt index of the heated mixture is low, the processability of the mixture may markedly decrease.

Also, in the present invention, while not subject to any particular limitation, it is preferable that the Shore D hardness of the intermediate layer minus the Shore D hardness of the solid core surface be within ±10, the upper limit being preferably 8 or less, more preferably 7 or less, and even more preferably 6 or less, and the lower limit being at least −7, more preferably at least −4, and even more preferably at least −1. When this hardness difference is above 10, the intermediate layer is too hard and the core is too soft, detracting from the feel of the ball and lowering the rebound and durability. On the other hand, when the hardness difference is below −10, the intermediate layer is too soft and the core is too hard, detracting from the feel of the ball on impact and lowering the ball rebound.

Next, the cover used in the present invention is described.

In the present invention, a polyurethane is used as the cover material. The polyurethane used must be a thermoplastic polyurethane or a thermoset polyurethane. When the cover material is made primarily of a polyurethane, golf balls having an excellent scuff resistance and an excellent spin stability on shots known as "fliers" can be obtained.

The thermoplastic polyurethane (referred to below as "thermoplastic polyurethane (A)") has a structure which includes soft segments made of a polymeric polyol (polymeric glycol) that is a long-chain polyol, and hard segments made of a chain extender and a polyisocyanate compound. Here, the long-chain polyol used as a starting material is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties. Alternatively, advantageous use may be made of polyester polyols because of their heat resistance and the broad molecular design capabilities they provide.

Illustrative examples of the above polyether polyol include poly(ethylene glycol), poly(propylene glycol), poly(tetramethylene glycol) and poly(methyltetramethylene glycol) obtained by the ring-opening polymerization of cyclic ethers. The polyether polyol may be used singly or as a combination of two or more thereof. Of the above, poly(tetramethylene glycol) and/or poly(methyltetramethylene glycol) are preferred.

It is preferable for these long-chain polyols to have a number-average molecular weight in a range of 1,500 to 5,000. By using a long-chain polyol having a number-average molecular weight within this range, golf balls made with a thermoplastic polyurethane composition having excellent properties such as resilience and manufacturability can be reliably obtained. The number-average molecular weight of the long-chain polyol is more preferably in a range of 1,700 to 4,000, and even more preferably in a range of 1,900 to 3,000.

As used herein, "number-average molecular weight of the long-chain polyol" refers to the number-average molecular weight calculated based on the hydroxyl number measured in accordance with JIS K-1557.

Any polyisocyanate compound employed in the prior art relating to thermoplastic polyurethane materials may be used without particular limitation. Illustrative examples include 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, dimer acid diisocyanate, 2,2,4- and 2,4,4-trimethylhexamethylene diisocyanate and lysine diisocyanate. However, depending on the type of isocyanate, the crosslinking reaction during injection molding may be difficult to control. In the practice of the invention, to provide a balance between stability at the time of production and the properties that are manifested, it is most preferable to use 4,4'-diphenylmethane diisocyanate as the isocyanate.

Any chain extender employed in the prior art relating to thermoplastic polyurethane materials may be used without particular limitation, with the use of a compound having on the molecule two or more active hydrogen atoms capable of reacting with isocyanate groups being preferred. For instance, use may be made of any ordinary polyol or polyamine. Specific examples include 1,4-butylene glycol, 1,2-ethylene glycol, 1,3-butanediol, 1,6-hexanediol, 2,2-dimethyl-1,3-propanediol, dicyclohexylmethylmethanediamine (hydrogenated MDI) and isophoronediamine (IPDA). These chain extenders have a number-average molecular weight of generally at least 20, preferably at least 25, and more preferably at least 30, but generally not more than 15,000, preferably not more than 10,000, more preferably not more than 5,000, and even more preferably not more than 1,000. Aliphatic diols having 2 to 12 carbons are preferred, and 1,4-butylene glycol is especially preferred.

No limitation is imposed on the specific gravity of the thermoplastic polyurethane (A), so long as it is suitably adjusted within a range that allows the objects of the invention to be achieved. The specific gravity is preferably at least 1.0, and more preferably at least 1.1, but preferably not more than 2.0, more preferably not more than 1.7, even more preferably not more than 1.5, and most preferably not more than 1.3.

It is most preferable for the above thermoplastic polyurethane (A) to be a thermoplastic polyurethane synthesized using a polyether polyol as the long-chain polyol, using an aliphatic diol as the chain extender, and using an aromatic diisocyanate as the polyisocyanate compound. It is desirable, though not essential, for the polyether polyol to be a polytetramethylene glycol having a number-average molecular weight of at least 1,900, for the chain extender to be 1,4-butylene glycol, and for the aromatic diisocyanate to be 4,4'-diphenylmethane diisocyanate.

The mixing ratio of active hydrogen atoms to isocyanate groups in the above polyurethane-forming reaction can be adjusted within a desirable range so as to make it possible to obtain a golf ball which is composed of a thermoplastic polyurethane composition and has various improved properties, such as rebound, spin performance, scuff resistance and manufacturability. Specifically, in preparing a thermoplastic polyurethane by reacting the above long-chain polyol, polyisocyanate compound and chain extender, it is desirable to use the respective components in proportions such that the amount of isocyanate groups on the polyisocyanate compound per mole of active hydrogen atoms on the long-chain polyol and the chain extender is from 0.95 to 1.05 moles.

No particular limitation is imposed on the method of preparing thermoplastic polyurethane (A). Production may be carried out by either a prepolymer process or a one-shot process in which the long-chain polyol, chain extender and polyisocyanate compound are used and a known urethane-forming reaction is effected. Of these, a process in which melt polymerization is carried out in a substantially solvent-free state is preferred. Production by continuous melt polymerization using a multiple screw extruder is especially preferred.

The thermoplastic polyurethane (A) used in the invention may be a commercial product. Illustrative examples include Pandex T8290, Pandex T8295 and Pandex T8260 (all manufactured by DIC Bayer Polymer, Ltd.), and Resamine 2593 and Resamine 2597 (both manufactured by Dainichi Seika Colour & Chemicals Mfg. Co., Ltd.).

The resin which forms the cover may be composed of the above-described thermoplastic polyurethane (A). A type of polyurethane in which the molecule has a partially crosslinked structure is preferred. The use of at least one type selected from the following two types of polyurethanes (first polyurethane, second polyurethane) is especially preferred for further enhancing the scuff resistance.

First Polyurethane

A thermoplastic polyurethane composition composed of the above-described thermoplastic polyurethane (A) and an isocyanate mixture (B) is used.

The isocyanate mixture (B) is preferably one prepared by dispersing (b-1) a compound having as functional groups at least two isocyanate groups per molecule in (b-2) a thermoplastic resin that is substantially non-reactive with isocyanate. The compound having as functional groups at least two isocyanate groups per molecule which serves as component (b-1) may be an isocyanate compound used in the prior art relating to polyurethanes, examples of which include aromatic isocyanates, hydrogenated aromatic isocyanates, aliphatic diisocyanates and alicyclic diisocyanates. Specific examples include isocyanate compounds such as those mentioned above. From the standpoint of reactivity and work safety, the use of 4,4'-diphenylmethane diisocyanate is preferred.

The thermoplastic resin that is substantially non-reactive with isocyanate which serves as component (b-2) is preferably a resin having a low water absorption and excellent compatibility with thermoplastic polyurethane materials. Illustrative, non-limiting, examples of such resins include polystyrene resins, polyvinyl chloride resins, ABS resins, polycarbonate resins and polyester thermoplastic elastomers (e.g., polyether-ester block copolymers, polyester-ester block copolymers).

For good rebound resilience and strength, the use of a polyester thermoplastic elastomer is especially preferred. No particular limitation is imposed on the polyester thermoplastic elastomer, provided it is a thermoplastic elastomer composed primarily of polyester. The use of a polyester-based block copolymer composed primarily of high-melting crystalline polymer segments made of crystalline aromatic polyester units and low-melting polymer segments made of aliphatic polyether units and/or aliphatic polyester units is preferred. In addition, up to 5 mol % of polycarboxylic acid ingredients, polyoxy ingredients and polyhydroxy ingredients having a functionality of three or more may be copolymerized. In the low-melting polymer segments made of aliphatic polyether units and/or aliphatic polyester units, illustrative examples of the aliphatic polyether include poly(ethylene oxide)glycol, poly(propylene oxide)glycol, poly(tetramethylene oxide)glycol, poly(hexamethylene oxide)glycol, copolymers of ethylene oxide and propylene oxide, ethylene oxide addition polymers of poly(propylene oxide) glycols, and copolymers of ethylene oxide and tetrahydrofuran. Illustrative examples of the aliphatic polyester include poly(ϵ-caprolactone), polyenantholactone, polycaprylolactone, poly(butylene adipate) and poly(ethylene adipate). Examples of polyester thermoplastic elastomers preferred for use in the invention include those in the Hytrel series made by DuPont-Toray Co, Ltd., and those in the Primalloy series made by Mitsubishi Chemical Corporation.

When the isocyanate mixture (B) is prepared, it is desirable for the relative proportions of above components (b-2) and (b-1), expressed as the weight ratio (b-2)/(b-1), to be within a range of 100/5 to 100/100, and especially 100/10 to 100/40. If the amount of component (b-1) relative to component (b-2) is too low, more isocyanate mixture (B) must be added to achieve an amount of addition adequate for the crosslinking reaction with the thermoplastic polyurethane (A). In such cases, component (b-2) exerts a large influence, which may make the physical properties of the thermoplastic polyurethane composition serving as the cover material inadequate. If, on the other hand, the amount of component (b-1) is too high, component (b-1) may cause slippage to occur during mixing, making it difficult to prepare the thermoplastic polyurethane composition used as the cover material.

The isocyanate mixture (B) can be prepared by blending component (b-1) into component (b-2) and thoroughly working together these components at a temperature of 130 to 250° C. using a mixing roll mill or a Banbury mixer, then either pelletizing or cooling and grinding. The isocyanate mixture (B) used may be a commercial product, a preferred example of which is Crossnate EM30 (made by Dainichi Seika Colour & Chemicals Mfg. Co., Ltd.). Above component (B) is included in an amount, per 100 parts by weight of component (A), of generally at least 1 part by weight, preferably at least 5 parts by weight, and more preferably at least 10 parts by weight, but generally not more than 100 parts by weight, preferably not more than 50 parts by weight, and more preferably not more than 30 parts by weight. Too little component (B) may make it impossible to achieve a sufficient crosslinking reaction, so that there is no apparent enhancement of the physical properties. On the other hand, too much may result in greater discoloration over time or due to the effects of heat and ultraviolet light, and may also have other undesirable effects, such as lowering the rebound.

Second Polyurethane

At least one cover layer is made of a molded resin composition consisting primarily of the above-described thermoplastic polyurethane (A) and a polyisocyanate compound (C). The resin composition has present therein a polyisocyanate compound within at least some portion of which all the isocyanate groups on the molecule remain in an unreacted state. Golf balls made with such a thermoplastic polyurethane have an excellent rebound, spin performance and scuff resistance.

The cover layer is composed mainly of a thermoplastic polyurethane, and is formed of a resin composition of primarily a thermoplastic polyurethane (A) and a polyisocyanate compound (C).

To fully exhibit the advantageous effects of the invention, a necessary and sufficient amount of unreacted isocyanate groups should be present in the cover-forming resin material. Specifically, it is recommended that the combined weight of above components A and C together be at least 60%, and preferably at least 70%, of the total weight of the cover layer.

Concerning the polyisocyanate compound used as component C, it is essential that, in at least some portion thereof within a single resin blend, all the isocyanate groups on the molecule remain in an unreacted state. That is, polyisocyanate compound in which all the isocyanate groups on the molecule remain in a completely free state should be present within a single resin blend, and such a polyisocyanate compound may be present together with polyisocyanate compound in which one end of the molecule is in a free state.

Various isocyanates may be used without particular limitation as the polyisocyanate compound. Specific examples include one or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Of the above group of isocyanates, using 4,4'-diphenylmethane diisocyanate, dicyclohexylmethane diisocyanate and isophorone diisocyanate is preferred for achieving a good balance between the effect on moldability by, for example, the rise in viscosity associated with reaction with the thermoplastic polyurethane (A), and the properties of the resulting golf ball cover material.

In the practice of the invention, although not an essential constituent, a thermoplastic elastomer other than the above-described thermoplastic polyurethane may be included as component D together with components A and C. Including this component D in the above resin composition enables the flow properties of the resin composition to be further improved and enables various properties required of golf ball cover materials, such as resilience and scuff resistance, to be increased.

Component D, which is a thermoplastic elastomer other than the above thermoplastic polyurethane, is exemplified by one or more thermoplastic elastomer selected from among polyester elastomers, polyamide elastomers, ionomer resins, styrene block elastomers, hydrogenated styrene-butadiene rubbers, styrene-ethylene/butylene-ethylene block copolymers and modified forms thereof, ethylene-ethylene/butylene-ethylene block copolymers and modified forms thereof, styrene-ethylene/butylene-styrene block copolymers and modified forms thereof, ABS resins, polyacetals, polyethylenes and nylon resins. The use of polyester elastomers, polyamide elastomers and polyacetals is especially preferred because, owing to reactions with isocyanate groups, the resilience and scuff resistance are enhanced while retaining a good manufacturability.

The relative proportions of above components A, C and D are not subject to any particular limitation, although to fully achieve the advantageous effects of the invention, it is preferable for the weight ratio A:C:D of the respective components to be from 100:2:50 to 100:50:0, and more preferably from 100:2:50 to 100:30:8.

In the practice of the invention, the resin composition is prepared by mixing component A with component C, and additionally mixing in also component D. It is critical to select the mixing conditions such that, of the polyisocyanate compound, at least some polyisocyanate compound is present in which all the isocyanate groups on the molecule remain in an unreacted state. For example, treatment such as mixture in an inert gas (e.g., nitrogen) or in a vacuum state must be furnished. The resin composition is then injection-molded around a core which has been placed in a mold. To smoothly and easily handle the resin composition, it is preferable for the composition to be formed into pellets having a length of 1 to 10 mm and a diameter of 0.5 to 5 mm. Isocyanate groups in an unreacted state remain in these resin pellets; the unreacted isocyanate groups react with component A or component D to form a crosslinked material while the resin composition is being injection-molded about the core, or due to post-treatment such as annealing thereafter.

The above method of molding the cover is exemplified by feeding the above-described resin composition to an injection molding machine, and injecting the molten resin composition around the core so as to form a cover layer. The molding temperature in this case varies according to such factors as the type of thermoplastic polyurethane, but is preferably in a range of 150 to 250° C.

When injection molding is carried out, it is desirable though not essential to carry out molding in a low-humidity environment such as by purging with a low-temperature gas using an inert gas (e.g., nitrogen or low dew-point dry air) or by vacuum treating some or all places on the resin paths from the resin feed area to the mold interior. Illustrative, non-limiting examples of the medium used for transporting the resin include low-moisture gases such as low dew-point dry air or nitrogen. By carrying out molding in such a low-humidity environment, reaction by the isocyanate groups is kept from proceeding before the resin has been charged into the mold interior. As a result, polyisocyanate in which the isocyanate groups are present in an unreacted state is included to some degree in the resin molded part, thus making it possible to reduce variable factors such as an unwanted rise in viscosity and enabling the real crosslinking efficiency to be enhanced.

Techniques that can be used to confirm the presence of polyisocyanate compound in an unreacted state within the resin composition prior to injection molding about the core include those which involve extraction with a suitable solvent that selectively dissolves out only the polyisocyanate compound. An example of a simple and convenient method is one in which confirmation is carried out by simultaneous thermogravimetric and differential thermal analysis (TG-DTA) measurement in an inert atmosphere. For example, when the resin composition (cover material) used in the invention is heated in a nitrogen atmosphere at a temperature ramp-up rate of 10° C./min, a gradual drop in the weight of diphenylmethane diisocyanate can be observed from about 150° C. On the other hand, in a resin sample in which the reaction between the thermoplastic polyurethane material and the isocyanate mixture has been carried out to completion, a weight drop from about 150° C. is not observed, but a weight drop from about 230 to 240° C. can be observed.

After the resin composition has been molded as described above, its properties as a golf ball cover can be further improved by carrying out annealing so as to induce the crosslinking reaction to proceed further. "Annealing," as used herein, refers to aging the cover in a fixed environment for a fixed length of time.

In addition to the above resin components, various optional additives may be included in the cover material in the present invention. Such additives include, for example, pigments, dispersants, antioxidants, ultraviolet absorbers, ultraviolet stabilizers, parting agents, plasticizers, and inorganic fillers (e.g., zinc oxide, barium sulfate, titanium dioxide, tungsten).

When such additives are included, the amount of the additives is suitably selected from a range within which the objects of the invention are achievable, although it is desirable for such additives to be included in an amount, per 100 parts by weight of the thermoplastic polyurethane serving as an essential component of the invention, of preferably at least 0.1 part by weight, and more preferably at least 0.5 part by weight, but preferably not more than 100 parts by weight, more preferably not more than 80 parts by weight, still more preferably not more than 20 parts by weight, still yet more preferably not more than 10 parts by weight, and most preferably not more than 5 parts by weight.

Molding of the cover using the thermoplastic polyurethane of the invention may be carried out by using an injection-molding machine to mold the cover over the intermediate layer which encases the core. Molding is carried out at a molding temperature of generally from 150 to 250° C.

Next, the cover of the inventive golf ball is formed so as to have a thickness, while not subject to any particular limitation, preferably from 0.5 to 1.5 mm. The thickness of the cover is more preferably at least 0.6 mm, even more preferably at least 0.7 mm, and further more preferably at least 0.8 mm, but more preferably not more than 1.4 mm, even more preferably not more than 1.3 mm, and further more preferably not more than 1.1 mm. If the cover is thinner than the above range, the durability will be inferior and the scuff resistance will worsen, or cracking will tend to arise. If the cover is too thick, the feel on impact will worsen or an increase in distance may not be achieved.

The cover material in the invention has a Shore D hardness, while not subject to any particular limitation, which is in a range of preferably from 53 to 65, and is more preferably at least 55, even more preferably at least 57, and further more preferably at least 58, but more preferably not more than 63, even more preferably not more than 61, and further more preferably not more than 59. At a low Shore D hardness, the distance decreases. On the other hand, if the Shore D hardness is too high, the ball has a hard feel on impact. In this way, the cover may have a Shore D hardness which is lower than in the prior art, enabling the controllability to be further increased without a loss of rebound.

With regard to the hardness relationship between the cover and the intermediate layer, while not subject to any particular limitation, it is desirable that the cover hardness is higher than the intermediate layer hardness. The Shore D hardness difference therebetween is while not subject to any particular limitation, preferably from 6 to 15, and more preferably at least 7, even more preferably at least 8, and further more preferably at least 9, but more preferably not more than 13, even more preferably not more than 12, and further more preferably not more than 11. Outside of the above hardness difference range, the durability to cracking may worsen or the feel on impact may worsen.

While not subject to any particular limitation, it is preferable for the cover and the intermediate layer to have a combined thickness of preferably from 1.5 and 3.5 mm. If the combined thickness is too large, the feel of the ball will worsen and the distance will decrease. Conversely, if the combined thickness is too small, the ball will have a lower durability. This combined thickness is more preferably at least 2 mm, even more preferably at least 2.3 mm, further more preferably at least 2.6 mm, and most preferably at least 2.9 mm, but more preferably not more than 3.5 mm, even more preferably not more than 3.4 mm, and further more preferably not more than 3.3 mm.

The golf ball diameter should accord with golf ball standards, and is preferably not less than 42.67 mm. The upper limit in the golf ball diameter is preferably not more than 44 mm, more preferably not more than 43.8 mm, even more preferably not more than 43.5 mm, and most preferably not more than 43 mm. Within the above range in golf ball diameter, it is critical that the deflection of the ball as a whole when compressed under a final load of 130 kgf from an initial load of 10 kgf (which deflection is also called the "product hardness") be in a range of from 2.9 to 5.0 mm. In this case, the product hardness is preferably at least 3.0 mm, more preferably at least 3.1 mm, and even more preferably at least 3.2 mm, but preferably not more than 4.5 mm, more preferably not more than 4.0 mm, and even more preferably not more than 3.8 mm.

To increase the aerodynamic performance and extend the distance traveled by the ball, the number of dimples formed on the ball surface is preferably from 250 to 400, more preferably at least 270, even more preferably at least 290, and most preferably at least 300, but more preferably not more than 380, even more preferably not more than 360, and most preferably not more than 340.

The sum of the dimple trajectory volumes VT (total dimple trajectory volume TVT) obtained by multiplying the volume V of each dimple by the square root of the dimple diameter $D_i$, while not subject to any particular limitation, is preferably at least 640, more preferably at least 645, even more preferably at least 650, and most preferably at least 655, but preferably not more than 800, more preferably not more than 770, even more preferably not more than 740, and most preferably not more than 710. In the present invention, TVT is the sum of VT ($=V\times D_i^{0.5}$) for each dimple. Here, the volume V of a dimple, although not shown in the diagrams, is the volume of the recessed region circumscribed by the edge of the dimple. The approximate trajectory height at high head speeds, particularly at head speeds of about 45 m/s to about 55 m/s, can be determined from this TVT value. Generally, the angle of elevation is large at a small TVT value, and is small at a large TVT value. At too small a TVT value, the trajectory will be too high, resulting in an insufficient run and thereby shortening the total distance. On the other hand, at too large a TVT value, the trajectory will be too low, resulting in an insufficient carry and shortening the distance. Moreover, outside the above TVT range, the ball will have a large variability in carry, lowering the stability of the ball performance in all such cases.

As explained above, the multi-piece solid golf ball of the invention, by optimizing the hardness profile of the solid core, optimizing the relationship between the intermediate layer, cover and core surface hardnesses, and moreover using a specific highly neutralized ionomer in the intermediate layer, has an excellent feel on impact and an excellent spin performance on approach shots, achieves a lower spin rate on full shots, and has an improved distance. Moreover, the ball rebound and durability precision are further enhanced, the scuff resistance is excellent, and molding can be carried out at a high productivity even when forming a thin cover.

EXAMPLES

The following Examples and Comparative Examples are provided by way of illustration and not by way of limitation.

Examples 1 to 8

Comparative Examples 1 to 6

Solid cores were fabricated by preparing core compositions in the respective formulations No. 1 to No. 7 shown in Tables 1 and 2, then molding and vulcanizing the compositions under vulcanization conditions of 160° C. and 13 minutes.

TABLE 1

| | Type | Manufacturer | Catalyst | cis-1,4 bonds (%) | 1,2-vinyl bonds (%) | Mooney viscosity | Mw/Mn |
|---|---|---|---|---|---|---|---|
| BR | BR01 | JSR | Ni | 96 | 2.5 | 46 | 4.2 |
| | BR730 | JSR | Nd | 96 | 1.3 | 55 | 3 |

TABLE 2

| | | No. 1 | No. 2 | No. 3 | No. 4 | No. 5 | No. 6 | No. 7 |
|---|---|---|---|---|---|---|---|---|
| Core | BR01 | 100 | | 100 | 100 | 100 | 100 | 100 |
| | BR730 | | 100 | | | | | |
| | Perhexa C-40 | 0.6 | 3 | 0.6 | 0.6 | 0.6 | 0.6 | 0.6 |
| | Actual amount added | 0.24 | 1.2 | 0.24 | 0.24 | 0.24 | 0.24 | 0.24 |
| | Percumyl D | 0.6 | 0 | 0.6 | 0.6 | 0.6 | 0.6 | 0.6 |
| | Zinc oxide | 24.5 | 24 | 23.5 | 20 | 23.5 | 33 | 25.5 |
| | Antioxidant | 0.1 | 0.1 | 0.1 | 0.1 | 0.1 | 0.1 | 0.1 |
| | Zinc stearate | 5 | 5 | 5 | 5 | 5 | 5 | 5 |
| | Zinc acrylate | 26 | 29 | 28 | 28.5 | 29 | 25 | 27.5 |
| | Zinc salt of pentachlorothiophenol | 1 | 1 | 1 | 1 | 0.2 | 1 | 1 |

Ingredient amounts shown above are in parts by weight.
Because Perhexa C-40 is a 40% dilution, the actual amount of addition is calculated and shown.

BR01: A polybutadiene rubber prepared with a nickel catalyst; available from JSR Corporation.

BR730: A polybutadiene rubber prepared with a neodymium catalyst; available from JSR Corporation.

Antioxidant: Available under the trade name "Nocrac NS-6" from Ouchi Shinko Chemical Industry Co., Ltd.

Zinc acrylate: Available from Nihon Jyoryu Kogyo Co., Ltd.

Perhexa C-40: 1,1-Bis(t-butylperoxy)cyclohexane diluted to 40% with an inorganic filler; available under this trade name from NOF Corporation.

Percumyl D: Dicumyl peroxide available under this trade name from NOF Corporation.

Zinc oxide: Available from Sakai Chemical Industry Co., Ltd.

Zinc stearate: Available as "Zinc Stearate G" from NOF Corporation.

Next, an intermediate layer and a cover were formed over the core by injection molding, in this order, the respective resin materials shown in Table 3.

The resin blends a, b and d in Table 3 were obtained by kneading the respective starting materials shown in the table (units: parts by weight) in a twin-screw extruder under a nitrogen atmosphere to give resin blends in which there remained unreacted isocyanate groups. These resin blends were then formed into pellets having a length of 3 mm and a diameter of 1 to 2 mm.

TABLE 3

| Trade name/ Substance | Type of polymer | A | B | C | D | a | b | c | d |
|---|---|---|---|---|---|---|---|---|---|
| Himilan 1605 | Binary copolymeric ionomer | | | | 50 | | | | |
| Himilan 1706 | Binary copolymeric ionomer | | | | 50 | | | | |
| Himilan 1601 | Binary copolymeric ionomer | | | | | | | 42.5 | |
| Himilan 1557 | Binary copolymeric ionomer | | | | | | | 42.5 | |
| Surlyn 7930 | Binary copolymeric ionomer | | | 30 | | | | | |
| Surlyn 6320 | Ternary copolymeric ionomer | | | 55 | | | | | |
| Nucrel AN4319 | Ethylene-methacrylic acid-acrylic acid ester ternary copolymer | 84 | 70 | | | | | | |
| Nucrel AN4318 | Same as above | | | 14.5 | | | | 15 | |
| Nucrel 1560 | Ethylene-methacrylic acid binary copolymer | 1 | 15 | | | | | | |
| Dynaron 6100P | Thermoplastic block copolymer composed of crystalline polyolefin block and polyethylene/ butylene random copolymer | 15 | 15 | | | | | | |
| Pandex T8260 | Thermoplastic polyurethane elastomer | | | | | 50 | 80 | | |
| Pandex T8295 | Thermoplastic polyurethane elastomer | | | | | 50 | 20 | | 75 |
| Pandex T8290 | Thermoplastic polyurethane elastomer | | | | | | | | 25 |
| Magnesium stearate | | 58.65 | 58.65 | 0.6 | 0.6 | | | | |
| Magnesium oxide | | 1.02 | 1.02 | | | | | | |
| Polytail H | | 2 | 2 | 2 | 2 | | | | |
| Titanium dioxide | | | | | | 3.5 | 3.5 | 4.8 | 3.5 |
| Polyethylene wax | | | | | | 1.5 | 1.5 | | 1.5 |
| Montan wax | | | | | | 0.8 | 0.8 | | 0.8 |
| Thermoplastic elastomer | | | | | | 15 | 15 | | 15 |
| Isocyanate compound | | | | | | 9 | 9 | | 9 |
| Shore D hardness | | 48 | 51 | 48 | 60 | 57 | 60 | 57 | 50 |
| MFR (g/10 min) | | 13.5 | 15 | 3.3 | 2.2 | | | | |

Ingredient amounts shown above are in parts by weight.

Himilan: Ionomer resins available from DuPont-Mitsui Polychemicals Co., Ltd.

Surlyn: Ionomer resins available from E.I. DuPont de Nemours and Co.

Pandex: Thermoplastic polyurethane elastomers available from Dainippon Ink & Chemicals, Inc. Resin blends a, b and d are single resin blends composed of thermoplastic polyurethane elastomers and isocyanate.

Magnesium oxide: "Kyowamag MF150"; available from Kyowa Chemical Industry.

Polytail H: A low-molecular-weight polyolefin polyol available from Mitsubishi Chemical Corporation.

Dimples

Figure 2:
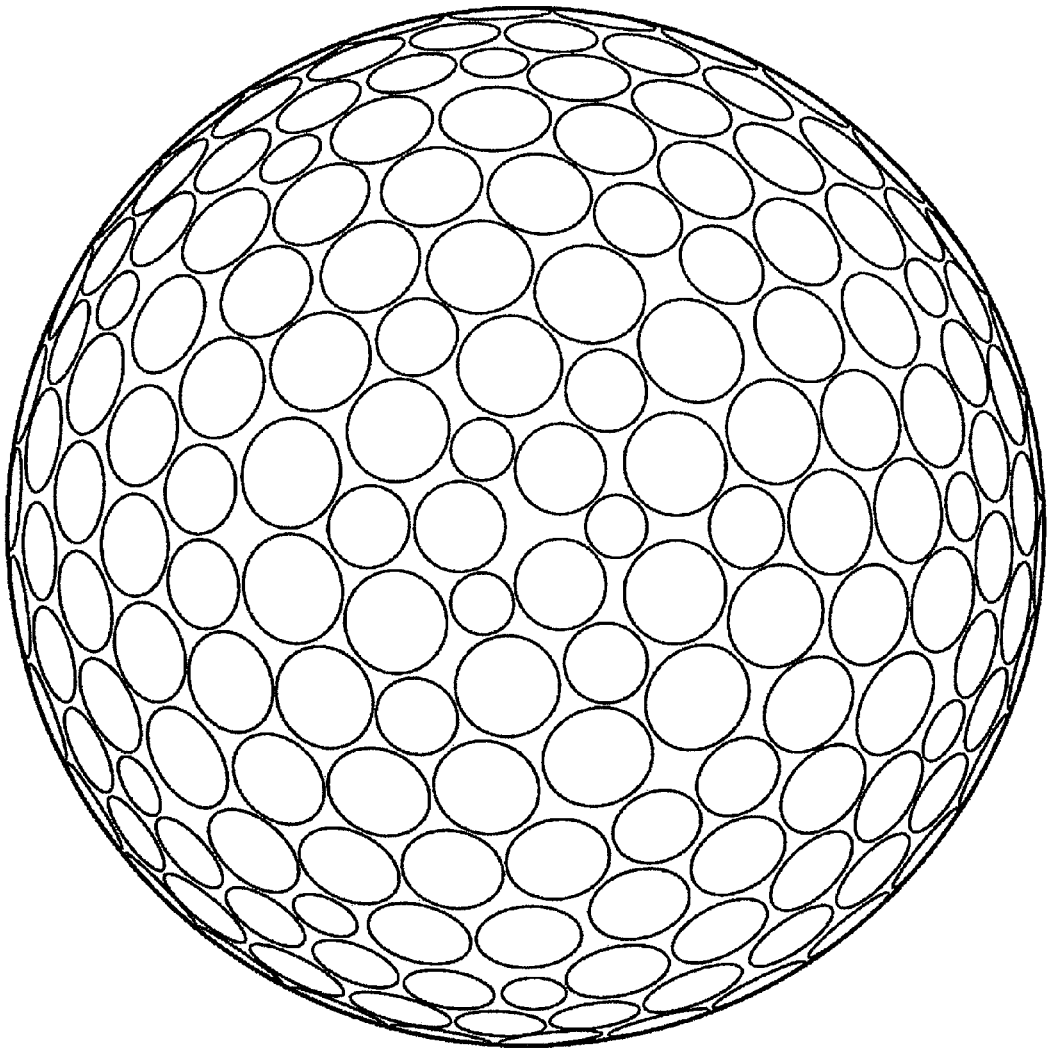
FIG. 2 is a plan view of the surface of the golf balls in the examples (Dimples I to III).

Configurations of a plurality of dimple types were used on the golf balls in the examples of the invention and the comparative examples. That is, use was made of dimple configuration I (336 dimples), dimple configuration II (336 dimples) and dimple configuration III (336 dimples). In each of these configurations, the dimples were arranged in a common pattern (shown in FIG. 2) on the balls, but the TVT values differed.

The following ball properties were measured in the resulting golf balls. In addition, flight tests were carried out by the method described below, and the spin rate on approach shots, feel on impact, and durability to consecutive impact were evaluated. The results are given in Tables 4 and 5.

Deflection on Loading from 10 kg to 130 kg

Using a model 4204 test system manufactured by Instron Corporation, the ball was compressed at a rate of 10 mm/min, and the difference between the deflection under a load of 10 kg and the deflection under a load of 130 kg was measured.

Cross-Sectional Hardness

The core was cut with a fine cutter, and the Shore D hardnesses at the center of the cross-section and at regions 5 mm, 10 mm and 15 mm from the center of the cross-section were measured.

Surface Hardness

The Shore D hardnesses at the surface of the core and at the surface of the finished product were measured.

Measurements of the cross-sectional and surface hardnesses were carried out at two places each on N=5 specimens. The Shore D hardnesses were values measured in accordance with ASTM D-2240 after temperature conditioning at 23° C.

Melt Flow Rate (MFR)

The melt flow rate was measured in accordance with JIS-K6760 (test temperature, 190° C.; test load, 21 N (2.16 kgf)).

Flight Performance

Each ball was struck ten times at a head speed (HS) of 45 m/s with the Tour Stage X-Drive (loft angle, 10.5°) driver (manufactured by Bridgestone Sports Co., Ltd.) mounted on a golf swing robot, and the spin rate (rpm) and total distance (m) were measured. The variance was rated based on the total left-right variation and the variation in distance.

Spin on Approach Shots

The spin rate (rpm) of the ball when struck at a head speed (HS) of 20 m/s with the Tour Stage X-Wedge (loft angle, 58°) sand wedge (SW) (manufactured by Bridgestone Sports Co., Ltd.) mounted on a golf swing robot was measured.

Feel

Three top amateur golfers rated the feel of the balls according to the following criteria when struck with a driver (W#1) at a head speed (HS) of 40 to 45 m/s, and when hit a distance of 5 to 10 m with a putter (#PT).

Good: Good feel

Fair: Somewhat hard or somewhat soft

NG: Too hard or too soft

Durability to Cracking

The ball was repeatedly fired against a steel plate wall at an incident velocity of 43 m/s, and the number of shots taken until the ball cracked was determined. The values shown are averages for N=5 specimens.

Scuff Resistance

Using a swing robot machine and using a non-plated pitching sand wedge as the club, each ball was hit at a head speed of 33 m/s while holding the ball at a temperature of 23° C., 13° C. or 0° C., following which the surface state of the ball was visually examined and rated as follows.

Good: Can be used again.

Fair: Can be used again, but the surface state is marginal.

NG: Cannot be used again.

TABLE 4

| | | | Example | | | | | | | |
|---|---|---|---|---|---|---|---|---|---|---|
| | | | 1 | 2 | 3 | 4 | 5 | 6 | 7 | 8 |
| Core | Type | | No. 1 | No. 2 | No. 3 | No. 3 | No. 3 | No. 3 | No. 3 | No. 4 |
| | Diameter (mm) | | 36.8 | 36.8 | 36.8 | 36.8 | 36.8 | 36.8 | 36.8 | 38 |
| | Deflection on 10-130 kg loading (mm) | | 4.6 | 4.2 | 4.2 | 4.2 | 4.2 | 4.2 | 4.2 | 4.2 |
| | Center hardness (Shore D) | | 31 | 32 | 34 | 34 | 34 | 34 | 34 | 34 |
| | Hardness 5 mm from center (Shore D) | | 32 | 36 | 35 | 35 | 35 | 35 | 35 | 35 |
| | Hardness 10 mm from center (Shore D) | | 34 | 36 | 38 | 38 | 38 | 38 | 38 | 38 |
| | Hardness 15 mm from center (Shore D) | | 36 | 46 | 40 | 40 | 40 | 40 | 40 | 40 |
| | Surface hardness (Shore D) | | 38 | 51 | 42 | 42 | 42 | 42 | 42 | 42 |
| | Hardness difference between core center and surface (Shore D) | | 7 | 19 | 8 | 8 | 8 | 8 | 8 | 8 |
| Intermediate layer | Type | | A | A | A | A | A | A | B | A |
| | Hardness (Shore D) | | 48 | 48 | 48 | 48 | 48 | 48 | 51 | 48 |
| | MFR | | 13.5 | 13.5 | 13.5 | 13.5 | 13.5 | 13.5 | 15 | 13.5 |
| | Hardness difference between intermediate layer and core surface (Shore D) | | +10 | −3 | +6 | +6 | +6 | +6 | +9 | +6 |
| | Thickness (mm) | | 1.95 | 1.95 | 1.95 | 1.95 | 1.95 | 1.95 | 1.95 | 1.35 |
| Cover | Type | | a | a | b | a | a | a | a | a |
| | Hardness (Shore D) | | 57 | 57 | 60 | 57 | 57 | 57 | 57 | 57 |
| | Hardness difference between cover and intermediate layer (Shore D) | | +9 | +9 | +12 | +9 | +9 | +9 | +6 | +9 |
| | Thickness (mm) | | 1.0 | 1.0 | 1.0 | 1.0 | 1.0 | 1.0 | 1.0 | 1.0 |
| | Combined thickness of cover + intermediate layer (mm) | | 2.95 | 2.95 | 2.95 | 2.95 | 2.95 | 2.95 | 2.95 | 2.35 |
| Product | Deflection on 10-130 kg loading (mm) | | 3.7 | 3.1 | 3.2 | 3.3 | 3.3 | 3.3 | 3.2 | 3.4 |
| | Diameter (mm) | | 42.7 | 42.7 | 42.7 | 42.7 | 42.7 | 42.7 | 42.7 | 42.7 |
| Dimples | Type | | I | I | I | I | II | III | I | I |
| | Number of dimples | | 336 | 336 | 336 | 336 | 336 | 336 | 336 | 336 |
| | TVT | | 675 | 675 | 675 | 675 | 702 | 643 | 675 | 675 |
| Distance | HS 45, driver | Spin rate (rpm) | 2450 | 2480 | 2500 | 2540 | 2540 | 2550 | 2490 | 2500 |
| | | Total (m) | 229.0 | 231.0 | 230.5 | 230.0 | 230.5 | 229.5 | 231.0 | 230.5 |
| Approach shots | HS 20 | Spin rate (rpm) | 5360 | 5450 | 5460 | 5520 | 5510 | 5520 | 5480 | 5520 |
| Initial velocity | (m/s) | | 77.3 | 77.5 | 77.4 | 77.5 | 77.5 | 77.5 | 77.6 | 77.6 |
| Durability | Durability to cracking (incident velocity, 43 m/s), shots | | 287 | 353 | 375 | 422 | 420 | 423 | 381 | 299 |
| | Scuff resistance | | good | good | fair | good | good | good | good | good |
| Feel | Driver | | good | good | good | good | good | good | good | good |
| | Putter | | good | good | fair | good | good | good | fair | good |

TABLE 5

| | | Comparative Example | | | | | |
|---|---|---|---|---|---|---|---|
| | | 1 | 2 | 3 | 4 | 5 | 6 |
| Core | Type | No. 5 | No. 3 | No. 6 | No. 3 | No. 7 | No. 3 |
| | Diameter (mm) | 36.8 | 36.8 | 36.1 | 36.8 | 35 | 36.8 |

TABLE 5-continued

| | | | Comparative Example | | | | | |
|---|---|---|---|---|---|---|---|---|
| | | | 1 | 2 | 3 | 4 | 5 | 6 |
| | Deflection on 10-130 kg loading (mm) | | 3.3 | 4.2 | 4.6 | 4.2 | 4.2 | 4.2 |
| | Center hardness (Shore D) | | 39 | 34 | 31 | 34 | 34 | 34 |
| | Hardness 5 mm from center (Shore D) | | 42 | 35 | 32 | 35 | 35 | 35 |
| | Hardness 10 mm from center (Shore D) | | 44 | 38 | 34 | 38 | 38 | 38 |
| | Hardness 15 mm from center (Shore D) | | 47 | 40 | 36 | 40 | 40 | 40 |
| | Surface hardness (Shore D) | | 50 | 42 | 38 | 42 | 42 | 42 |
| | Hardness difference between core center and surface (Shore D) | | 11 | 8 | 7 | 8 | 8 | 8 |
| Intermediate layer | Type | | A | C | A | A | A | D |
| | Hardness (Shore D) | | 48 | 48 | 48 | 48 | 48 | 62 |
| | MFR | | 13.5 | 3.3 | 13.5 | 13.5 | 13.5 | 2.2 |
| | Hardness difference between intermediate layer and core surface (Shore D) | | −2 | +6 | +10 | +6 | +6 | +20 |
| | Thickness (mm) | | 1.95 | 1.95 | 1.95 | 1.95 | 2.3 | 1.95 |
| Cover | Type | | a | a | c | d | a | a |
| | Hardness (Shore D) | | 57 | 57 | 57 | 50 | 57 | 57 |
| | Hardness difference between cover and intermediate layer (Shore D) | | +9 | +9 | +9 | +2 | +9 | −5 |
| | Thickness (mm) | | 1.0 | 1.0 | 1.35 | 1.0 | 1.55 | 1.0 |
| | Combined thickness of cover + intermediate layer (mm) | | 2.95 | 2.95 | 3.3 | 2.95 | 3.85 | 2.95 |
| Product | Deflection on 10-130 kg loading (mm) | | 2.5 | 3.3 | 3.7 | 3.4 | 2.9 | 2.8 |
| | Diameter (mm) | | 42.7 | 42.7 | 42.7 | 42.7 | 42.7 | 42.7 |
| Dimples | Type | | I | I | I | I | I | I |
| | Number of dimples | | 336 | 336 | 336 | 336 | 336 | 336 |
| | TVT | | 675 | 675 | 675 | 675 | 675 | 675 |
| Distance | HS 45, driver | Spin rate (rpm) | 2750 | 2570 | 2570 | 2670 | 2580 | 2280 |
| | | Total (m) | 229.0 | 227.0 | 227.5 | 226.5 | 226.0 | 230.0 |
| Approach shots | HS 20 | Spin rate (rpm) | 5740 | 5500 | 5280 | 5700 | 5480 | 5270 |
| Initial velocity | (m/s) | | 77.7 | 77 | 77.3 | 77.5 | 76.9 | 77.4 |
| Durability | Durability to cracking (incident velocity, 43 m/s), shots | | 650 | 455 | 273 | 422 | 552 | 296 |
| | Scuff resistance | | fair | good | poor | good | good | fair |
| Feel | Driver | | poor | good | good | good | poor | fair |
| | Putter | | fair | good | good | good | poor | poor |

In Comparative Example 1, the finished ball was too hard. As a result, the ball had a hard feel, the spin rate was excessive, and the distance decreased.

In Comparative Example 2, the intermediate layer material was made of a conventional ionomer. As a result, the ball had a low rebound and a reduced distance.

In Comparative Example 3, the cover was made of an ionomer. As a result, on shots with a driver, the ball had a high spin rate and a reduced distance. In addition, on approach shots, the ball had a low spin rate and a poor controllability.

In Comparative Example 4, the cover was soft. As a result, on shots with a driver, the ball had a high spin rate and a reduced distance.

In Comparative Example 5, the cover was thick. As a result, the ball had a low rebound and a poor distance. In addition, the ball had a hard feel.

In Comparative Example 6, the intermediate layer was hard. As a result, the ball had a low spin rate on approach shots and had a hard feel on shots with a putter.

The invention claimed is:

1. A multi-piece solid golf ball comprising a solid core, a cover, at least one intermediate layer situated therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to 10 mm from the core center of from 23 to 41, a Shore D hardness 15 mm from the core center of from 28 to 46, and a Shore D hardness at a surface of the core of from 37 to 62; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random copolymer and/or a metal salt thereof, (b) from 0 to 20 wt % of an olefin-unsaturated carboxylic acid random copolymer and/or a metal salt thereof, and (c) from 5 to 50 wt % of a thermoplastic block copolymer composed of a crystalline polyolefin block and a polyethylene/butylene random copolymer, (d) from 5 to 170 parts by weight of a fatty acid or fatty acid derivative having a molecular weight of from 280 to 1500, and (e) from 0.1 to 10 parts by weight of a basic inorganic metal compound capable of neutralizing acid groups within components (a) and (d);

the intermediate layer material has a Shore D hardness of from 35 to 60 and has a Shore D hardness difference with the surface of the solid core of within ±10; the cover is formed primarily of polyurethane, has a thickness of from 0.5 to 1.5 mm, and has a Shore D hardness of from 53 to 65 which is higher than the intermediate layer hardness, the Shore D hardness difference therebetween being from 6 to 15; the overall ball has a deflection, when compressed under a final load of 130 kgf from an initial load of 10 kgf, of from 2.9 to 5.0 mm; and the number of dimples is from 250 to 400 and the sum of the dimple trajectory volumes VT (total dimple trajectory volume TVT) obtained by multiplying the volume of each dimple by the square root of the dimple diameter is from 640 to 800.

2. The multi-piece solid golf ball of claim 1, wherein the intermediate layer material has a melt flow rate (MFR) of from 5 to 30 g/10 min.

3. A multi-piece solid golf ball comprising a solid core, a cover, at least one intermediate layer situated therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to 10 mm from the core center of from 23 to 41, a Shore D hardness 15 mm from the core center of from 28 to 46, and a Shore D hardness at a surface of the core of from 37 to 62; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random copolymer and/or a metal salt thereof, (b) from 0 to 20 wt % of an olefin-unsaturated carboxylic acid random copolymer and/or a metal salt thereof, and (c) from 5 to 50 wt % of a thermoplastic block copolymer composed of a crystalline polyolefin block and a polyethylene/butylene random copolymer, (d) from 5 to 170 parts by weight of a fatty acid or fatty acid derivative having a molecular weight of from 280 to 1500, and (e) from 0.1 to 10 parts by weight of a basic inorganic metal compound capable of neutralizing acid groups within components (a) and (d);

the intermediate layer has a thickness of from 1.0 to 2.5 mm; the intermediate layer material a Shore D hardness difference with the surface of the solid core of within ±10; the cover is formed primarily of polyurethane, has a thickness of from 0.5 to 1.5 mm, and has a Shore D hardness higher than the intermediate layer hardness, the Shore D hardness difference therebetween being from 6 to 15; the cover and the intermediate layer have a combined thickness of from 1.5 to 3.5 mm; and the overall ball has a deflection, when compressed under a final load of 130 kgf from an initial load of 10 kgf, of from 2.9 to 5.0 mm; and the number of dimples is from 250 to 400 and the sum of the dimple trajectory volumes VT (total dimple trajectory volume TVT) obtained by multiplying the volume of each dimple by the square root of the dimple diameter is from 640 to 800.

4. The multi-piece solid golf ball of claim 3, wherein the intermediate layer material has a melt flow rate (MFR) of from 5 to 30 g/10 min.

5. A multi-piece solid golf ball comprising a solid core, a cover, at least one intermediate layer situated therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to 10 mm from the core center of from 23 to 41, a Shore D hardness 15 mm from the core center of from 28 to 46, and a Shore D hardness at a surface of the core of from 37 to 62; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random copolymer and/or a metal salt thereof, (b) from 0 to 20 wt % of an olefin-unsaturated carboxylic acid random copolymer and/or a metal salt thereof, and (c) from 5 to 50 wt % of a thermoplastic block copolymer composed of a crystalline polyolefin block and a polyethylene/butylene random copolymer, (d) from 5 to 170 parts by weight of a fatty acid or fatty acid derivative having a molecular weight of from 280 to 1500, and (e) from 0.1 to 10 parts by weight of a basic inorganic metal compound capable of neutralizing acid groups within components (a) and (d);

the intermediate layer has a thickness of from 1.0 to 2.5 mm; the intermediate layer material has a Shore D hardness of from 35 to 60; the cover is formed primarily of polyurethane, has a thickness of from 0.5 to 1.5 mm, and has a Shore D hardness of from 53 to 65; the cover and the intermediate layer have a combined thickness of from 1.5 to 3.5 mm; and the overall ball has a deflection, when compressed under a final load of 130 kgf from an initial load of 10 kgf, of from 2.9 to 5.0 mm; and the number of dimples is from 250 to 400 and the sum of the dimple trajectory volumes VT (total dimple trajectory volume TVT) obtained by multiplying the volume of each dimple by the square root of the dimple diameter is from 640 to 800.

6. The multi-piece solid golf ball of claim 5, wherein the intermediate layer material has a melt flow rate (MFR) of from 5 to 30 g/10 min.

7. A multi-piece solid golf ball comprising a solid core, a cover, at least one intermediate layer situated therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to 10 mm from the core center of from 23 to 41, a Shore D hardness 15 mm from the core center of from 28 to 46, a Shore D hardness at a surface of the core of from 37 to 62 and a Shore D hardness difference of 5 to 30 between the surface and the center; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random copolymer and/or a metal salt thereof, (b) from 0 to 20 wt % of an olefin-unsaturated carboxylic acid random copolymer and/or a metal salt thereof, and (c) from 5 to 50 wt % of a thermoplastic block copolymer composed of a crystalline polyolefin block and a polyethylene/butylene random copolymer, (d) from 5 to 170 parts by weight of a fatty acid or fatty acid derivative having a molecular weight of from 280 to 1500, and (e) from 0.1 to 10 parts by weight of a basic inorganic metal compound capable of neutralizing acid groups within components (a) and (d);

the intermediate layer has a thickness of from 1.0 to 2.5 mm; the intermediate layer material has a Shore D hardness difference with the surface of the solid core of within ±10; the cover is formed primarily of polyurethane, has a thickness of from 0.5 to 1.5 mm, and has a Shore D hardness higher than the intermediate layer hardness, the Shore D hardness difference therebetween being from 6 to 15; the cover and the intermediate layer have a combined thickness of from 1.5 to 3.5 mm; and the overall ball has a deflection, when compressed under a final load of 130 kgf from an initial load of 10 kgf, of from 2.9 to 5.0 mm; and the number of dimples is from 250 to 400 and the sum of the dimple trajectory volumes VT (total dimple trajectory volume TVT) obtained by multiplying the volume of each dimple by the square root of the dimple diameter is from 640 to 800.

8. The multi-piece solid golf ball of claim 7, wherein the intermediate layer material has a melt flow rate (MFR) of from 5 to 30 g/10 min.

* * * * *